US007784207B2

(12) United States Patent
Curtis

(10) Patent No.: US 7,784,207 B2
(45) Date of Patent: Aug. 31, 2010

(54) DISPLAY FRAMING SYSTEMS AND RELATED METHODS

(75) Inventor: Donald R. Curtis, Thornton, CO (US)

(73) Assignee: Lighted Promotions, Inc., Thornton, CO (US)

( * ) Notice: Subject to any disclaimer, the term of this patent is extended or adjusted under 35 U.S.C. 154(b) by 632 days.

(21) Appl. No.: 11/431,479

(22) Filed: May 10, 2006

(65) Prior Publication Data

US 2007/0017132 A1 Jan. 25, 2007

Related U.S. Application Data

(60) Provisional application No. 60/679,544, filed on May 10, 2005.

(51) Int. Cl.
*G09F 21/04* (2006.01)

(52) U.S. Cl. ..... 40/590; 40/546

(58) Field of Classification Search ..... 40/714, 40/544, 546, 570
See application file for complete search history.

(56) References Cited

U.S. PATENT DOCUMENTS

| | | | | | |
|---|---|---|---|---|---|
| 4,383,382 | A * | 5/1983 | Hegarty | 40/545 |
| 4,922,384 | A * | 5/1990 | Torrence | 362/611 |
| 5,005,306 | A * | 4/1991 | Kinstler | 362/486 |
| 5,251,392 | A * | 10/1993 | McManigal | 40/427 |
| 5,265,357 | A * | 11/1993 | Yu | 40/714 |
| 5,365,411 | A * | 11/1994 | Rycroft et al. | 362/20 |
| 5,367,801 | A * | 11/1994 | Ahn | 40/714 |
| 5,555,654 | A * | 9/1996 | Hermann | 40/714 |
| 5,943,801 | A * | 8/1999 | Wilkinson | 40/564 |
| 6,865,835 | B1 * | 3/2005 | Webster | 40/591 |
| 6,945,584 | B1 * | 9/2005 | Alber | 296/57.1 |
| 7,089,694 | B2 * | 8/2006 | Allen | 40/607.04 |

* cited by examiner

*Primary Examiner*—Joanne Silbermann
(74) *Attorney, Agent, or Firm*—Lathrop & Gage LLP

(57) ABSTRACT

A display framing system that may be used in mobile applications, such as on tractor trailers or buses, is disclosed. The display framing system may be illuminated, and the light reflected onto a sign inserted in the framing system.

14 Claims, 10 Drawing Sheets

DISPLAY FRAMING SYSTEMS AND RELATED METHODS

RELATED APPLICATIONS

This application claims priority to U.S. Application No. 60/679,544, filed May 10, 2005, which is incorporated herein by reference.

BACKGROUND

Many existing mobile advertising systems utilize tensioning frames that stretch a canvas over the lateral side of a tractor trailer. Other advertising systems simply paint displays directly on the vehicle or apply them as adhesive panels to the vehicle surface. All of these display methods suffer drawbacks. Signs attached to the lateral sides of trucks are exposed to high winds and they are usually viewed for a very short period of time by occupants of a passing vehicle. Advertising exposure is additionally limited to daylight hours as headlight illumination is typically insufficient for adequate viewing at night. From a mechanical point of view, tensioning systems require complex and costly frames with specialized clamps, rails, tensioners and bungee cords. The systems are also prone to mechanical failure and weather-related deterioration that could lead to loss of life and/or property. Adhesive systems and painting are somewhat safer in transit, but removal and replacement of signage can be a troublesome, time consuming and chemically-intensive process.

SUMMARY

In one embodiment a display framing system includes four edges disposed on the periphery of and substantially perpendicular to a back surface, the four edges include an outside edge and an inside edge, where the depth of the outside edge is less than the depth of the inside edge. A front surface is disposed planar to the back surface and includes an opening for placement of a sign therein.

In one embodiment a method of displaying a sign includes providing a framing system having four edges disposed on the periphery of and substantially perpendicular to a back surface, the four edges include an outside edge and an inside edge, where the depth of the outside edge is less than the depth of the inside edge, and a front surface is disposed planar to the back surface, the front surface includes an opening for placement of a sign therein. The method includes inserting a sign into the opening of the front surface.

In one embodiment, a method of displaying a sign includes providing on a rear door of a tractor trailer a framing system having a back surface, four edges disposed on the periphery of and substantially perpendicular to the back surface, the four edges include an outside edge and an inside edge, where the depth of the outside edge is less than the depth of the inside edge, and a front surface disposed planar to the back surface, the front surface includes an opening for placement of a sign therein. The method includes inserting a sign into the opening of the front surface.

DETAILED DESCRIPTION

The present disclosure relates to display framing systems and, more specifically, to systems that are mountable on doors and/or vehicles, and optionally lit. A mobile display framing system, such as described herein, may be advantageously located on the back of a tractor trailer or bus, where it can be kept out of the wind and where following vehicles can view an advertisement disposed therein for a considerable length of time. The display may be lit, especially at night, to increase the effective advertising time and thus the number of people viewing the advertisement.

In one embodiment, a display framing system may be used to secure a Plexiglas® sign to a surface of a door (e.g., the rear door of a tractor trailer); though it is nonetheless understood that the present systems may be used with any interior or exterior door, gate, stall or other hinged body, for example. A frame assembly retains a semi-flexible sheet-like panel or sign within a substantially rectangular frame. The frame is adapted to contain peripheral edges of the sign within an opening in the front surface of the frame system. The frame is further designed with a canted orientation that allows doors to be opened without interference from or damage to the frame system or vehicle.

In another embodiment, a display framing system may be mounted on an unhinged body, e.g., a posterior portion of a bus. A canted orientation of the display framing system may allow a sign within the display framing system to be angled for improved viewing.

If a sign contained within the framing system is lit, lighting provides evenly distributed light by use of reflector panels. Power for the lighting may be provided by an independent battery or by the power system of a vehicle. It will be understood that converters and/or inverters that form part of the existing electrical system of the vehicle may be used to manipulate power for the display framing system. Alternatively, converters and/or inverters may be incorporated into the display framing system.

Figure 1:
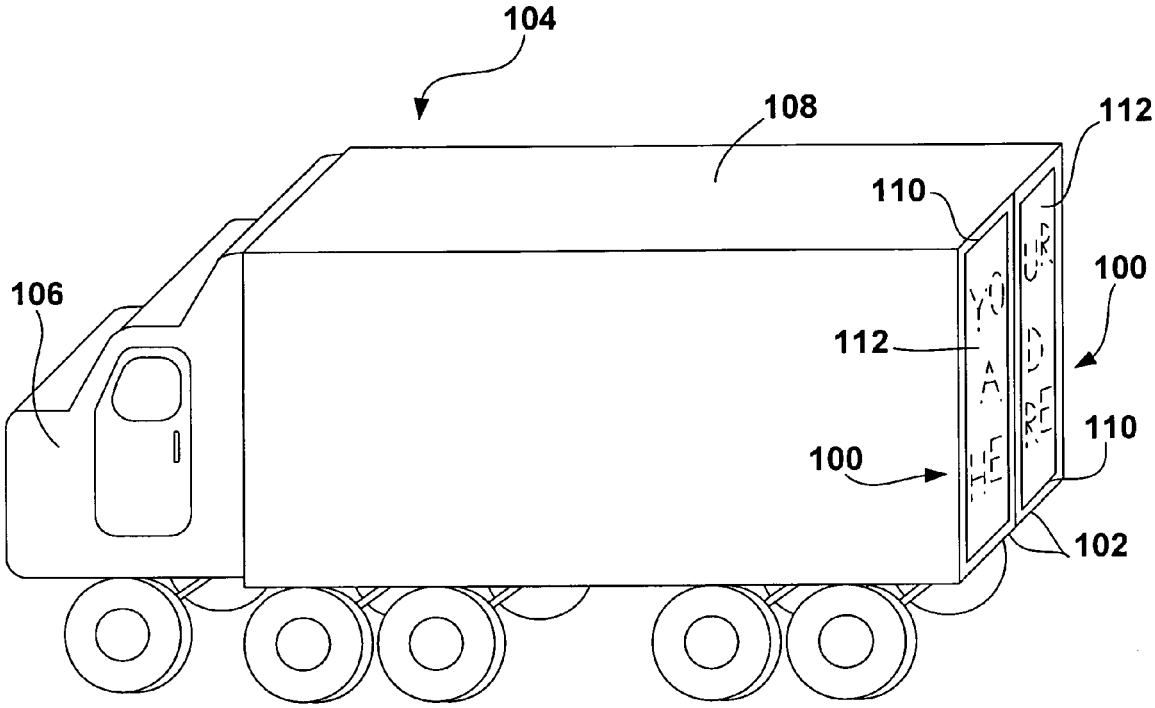
FIG. 1 illustrates display framing systems mounted on rear doors of a tractor trailer in accordance with an embodiment.

FIG. 1 illustrates two display framing systems 100 mounted on the rear doors 102 of a tractor trailer 104, which includes a motor truck 106 and a semi-trailer 108 rigged thereto. Systems 100 include a frame assembly 110, a sign 112 and, optionally, lighting apparatus (not shown). Each framing system 100 may be fixedly attached to the door of the tractor trailer using hardened steel bolts or other suitable means known in the art.

Figure 2:
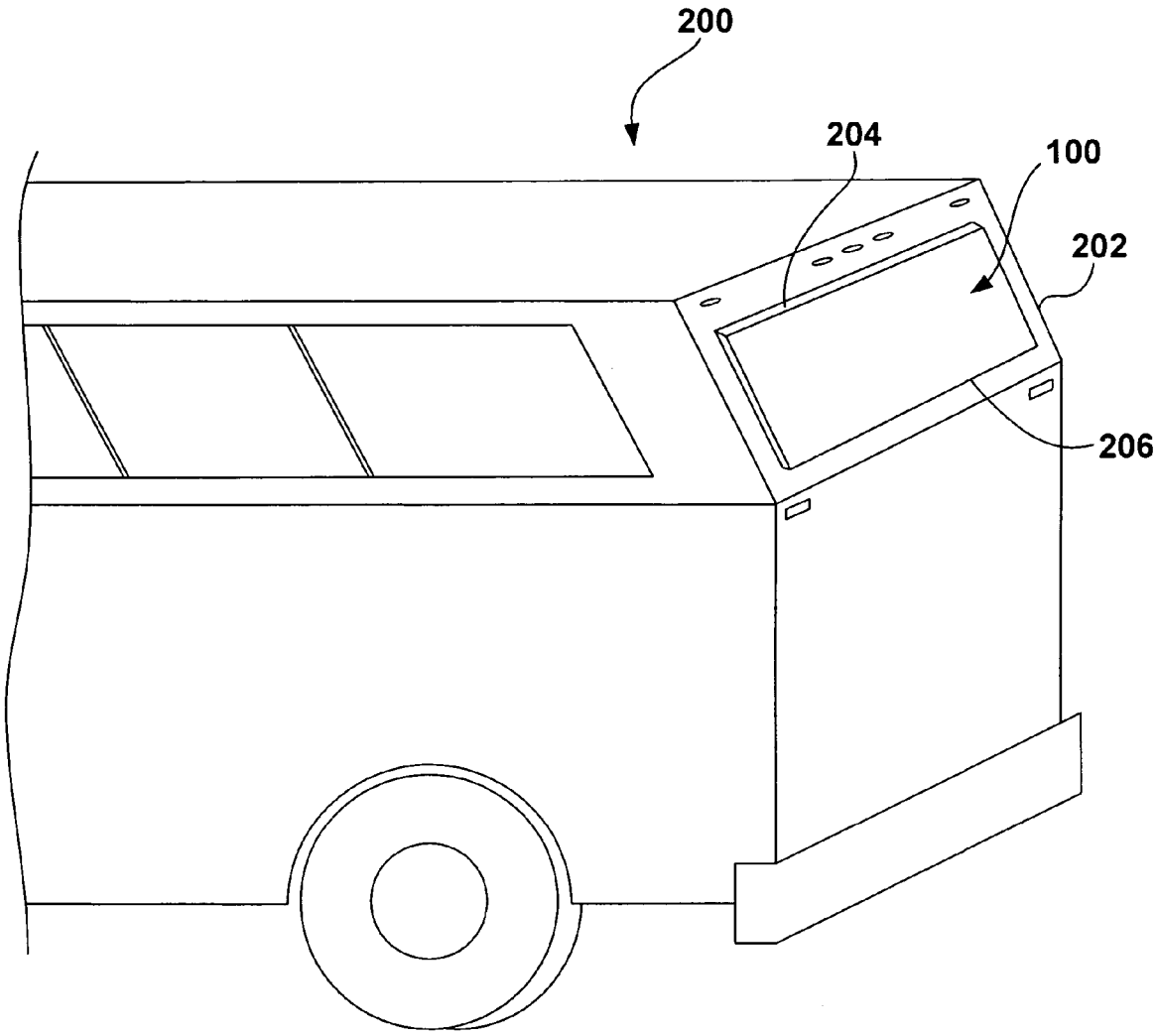
FIG. 2 illustrates a partial cut-away view of a display framing system mounted on a top posterior portion of a bus in accordance with an embodiment.
Figure 3:
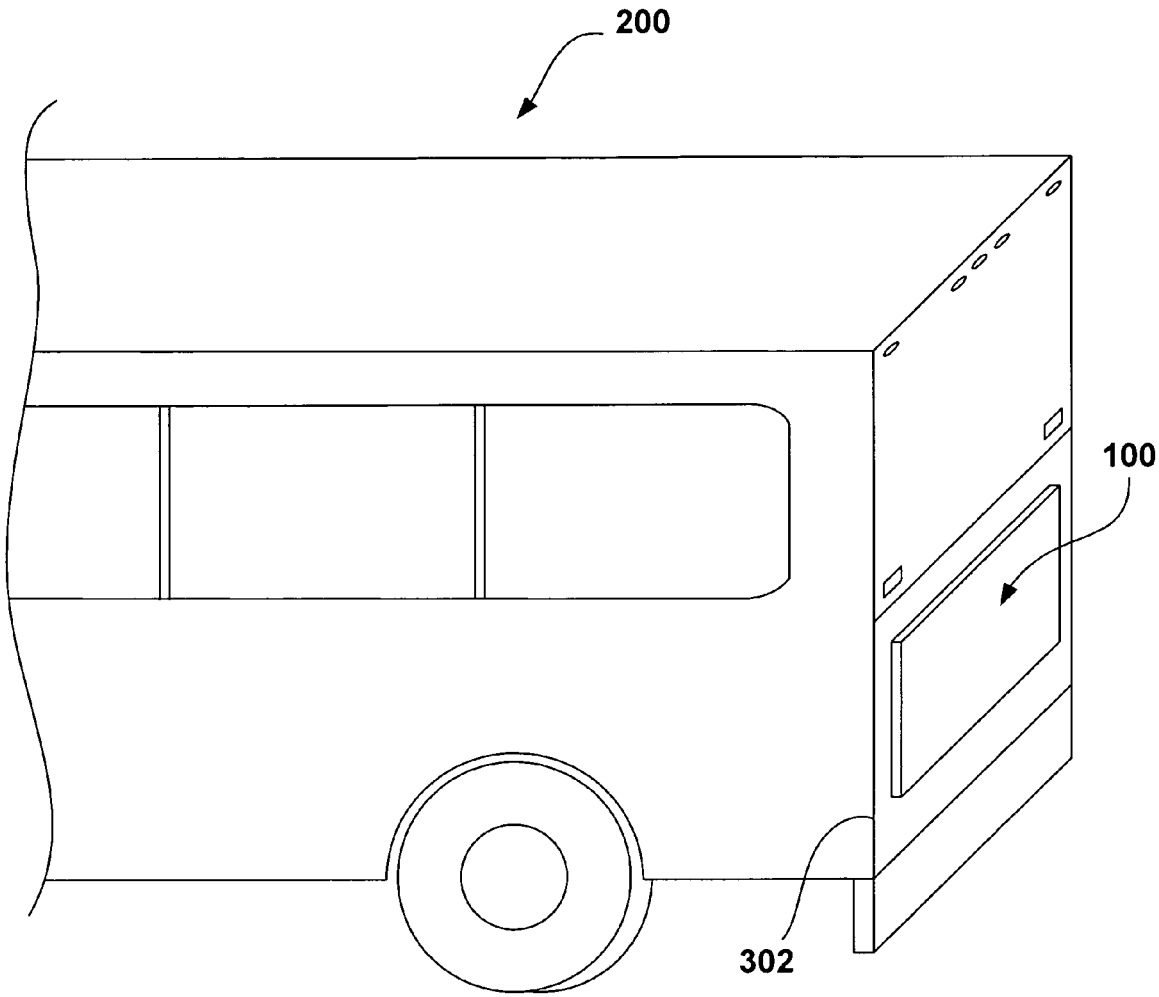
FIG. 3 illustrates a partial cut-away view of a display framing system mounted on a bottom posterior portion of a bus in accordance with an embodiment.

FIGS. 2 and 3 illustrate partial cut-away views of display framing systems 100 mounted to posterior portions of a bus 200. Display framing system 100 of FIG. 2 is positioned on a top portion 202 of bus 200. It may be desirable in such an orientation for top edge 204 of framing system 100 to have a greater depth than bottom edge 206. A downward canting may, for example, enable better viewing from passenger cars. FIG. 3 illustrates a framing system 100 positioned on a bottom portion 302 of bus 200, where it may or may not be necessary to cant display framing system 100 for better viewing.

Figure 4:
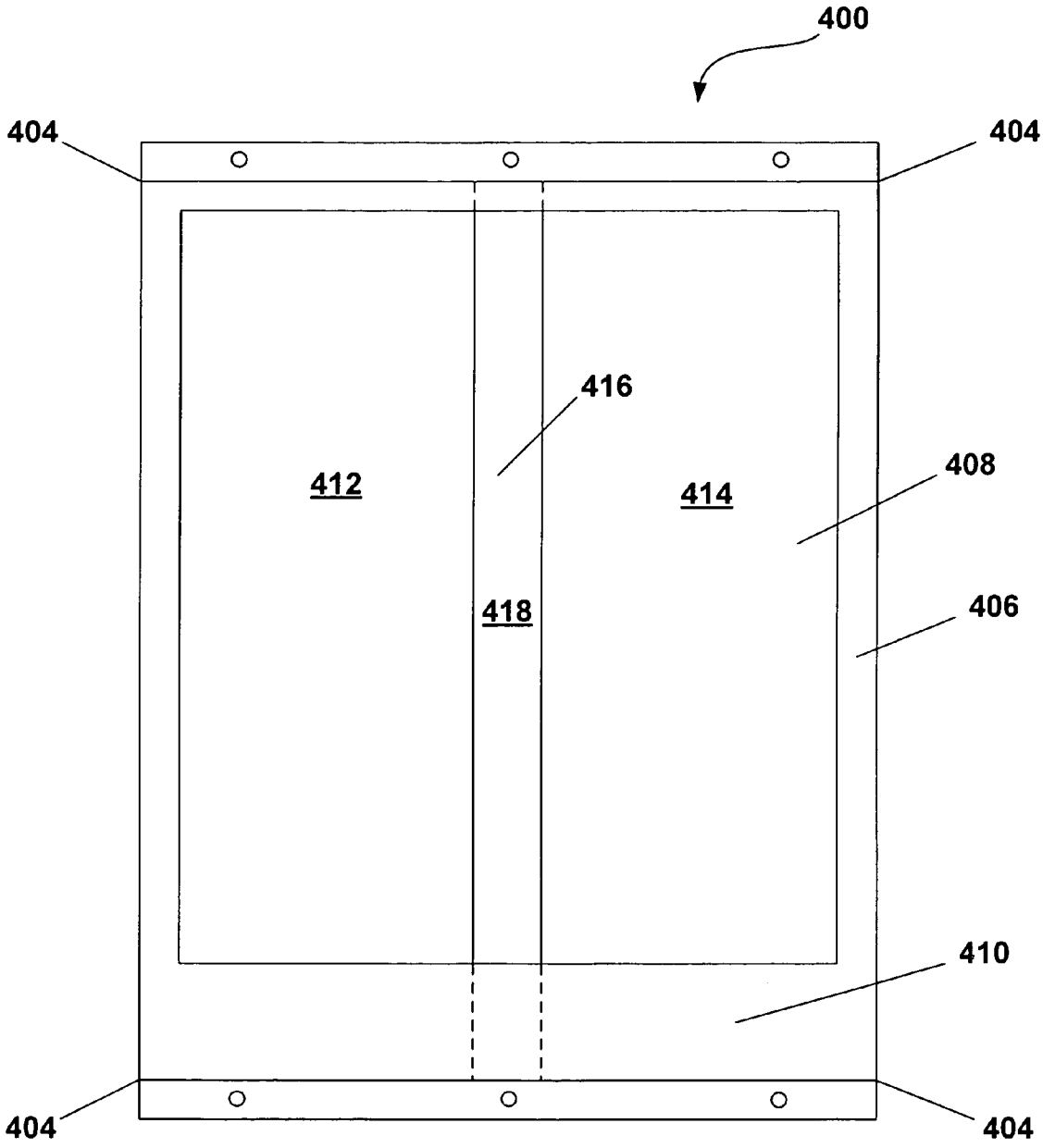
FIG. 4 shows a front plan view of one display framing system in accordance with an embodiment.

FIG. 4 shows a front plan view of one display framing system 400. System 400 is generally a three-dimensional rectangular frame having a substantially flat and rectangular back surface. The back surface may be a pre-existing body (e.g., door 102 of truck 104) to which framing system 400 attaches. Four edges disposed on the periphery of and substantially perpendicular to the back surface form approximate right angles at four corners 404 of framing system 400. The edges form a depth of the framing system of about 2-3 inches. A front surface 406 of similar dimension and disposed planar to the back surface includes an opening 408 where a sign (not shown) may be inserted. The dimensions of the back surface may be approximately 70"×34" with an opening of approximately 64"×32" for a framing system used on the rear door of a tractor trailer. In one embodiment, at least one portion 410 of the front surface is of sufficient depth to enclose optional lighting apparatus (not shown in FIG. 4; see FIGS. 9-14). In the present embodiment, the lighting system portion 410 is shown on the bottom of the sign. However, the lighting system portion 410 could alternatively be located at the top or side of the sign. More than one lighting apparatus may be accommodated within the framing system. The framing system 400 also includes two longitudinal reflector panels 412, 414 that are angled toward the center 416 of the framing system. Reflector panels may be planar or curved into an approximately parabolic shape. In one embodiment, the reflector panels do not touch and the back surface 418 may be observed in a gap formed there between. The framing system and/or reflector panels may be fabricated from white powder-coated aluminum, polished or unpolished metal, a mirrored material or rigid materials that efficiently reflect light from a lighting system.

Figure 5:
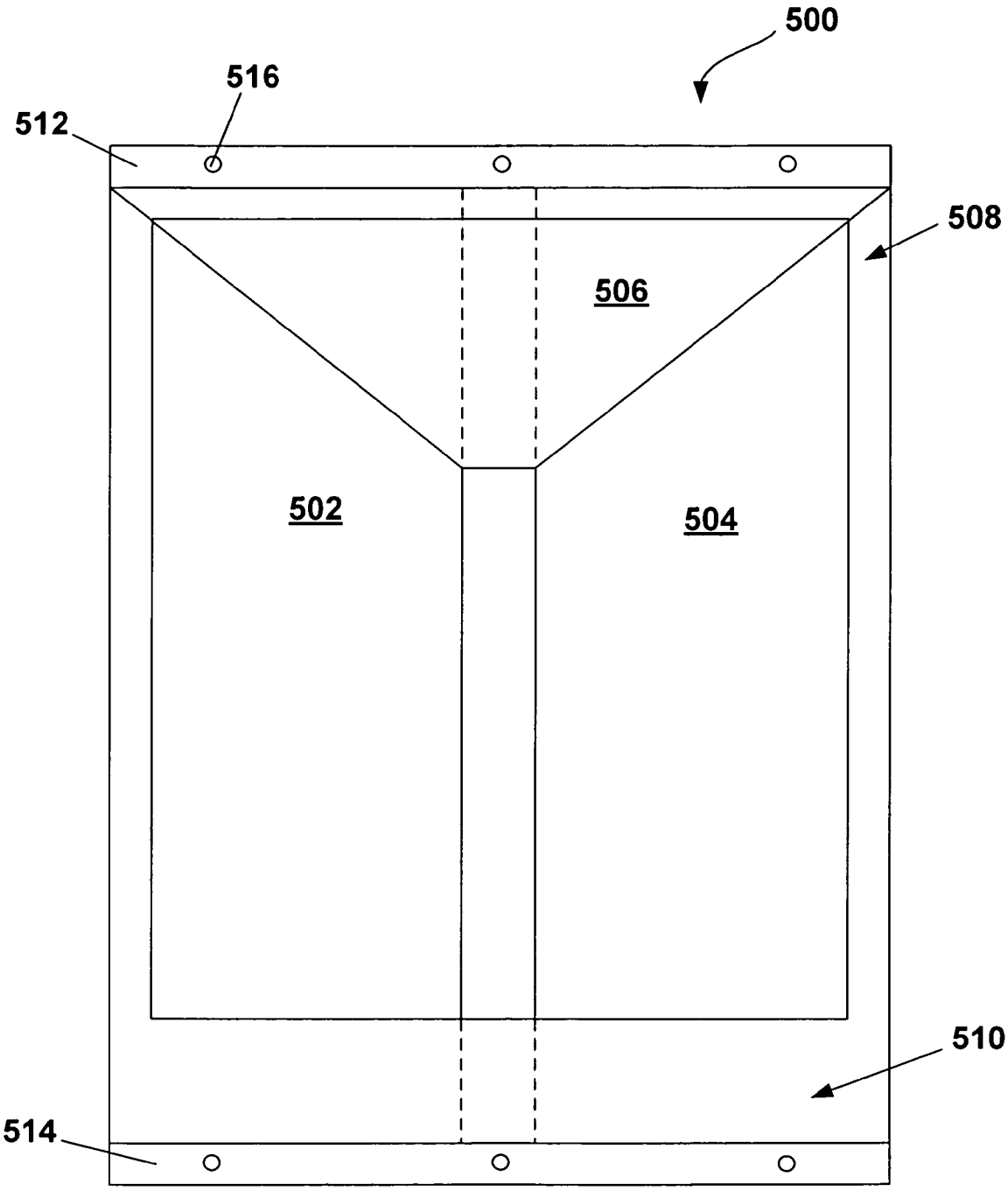
FIG. 5 shows a front plan view of one display framing system in accordance with an embodiment.

FIG. 5 shows a front plan view of one display framing system 500, which includes three reflector panels 502, 504, 506. Two of the reflector panels 502, 504 are longitudinal, while the third reflector panel 506 forms a substantially triangular segment disposed near a top 508 of the framing system 500. Third reflector panel 506 may be desirable when a lighting apparatus is incorporated at a bottom 510 of the framing system. Light shined upward by the lighting apparatus may be reflected downward and forward by reflector panel 506. Although the present embodiment has been described with reference to three reflector panels, it is contemplated that a framing system 500 may incorporate one or a plurality of reflector panels. A framing system may also include mounting panels 512, 514 containing holes for receiving hardened steel bolts 516 or other suitable securing means.

Figure 6:
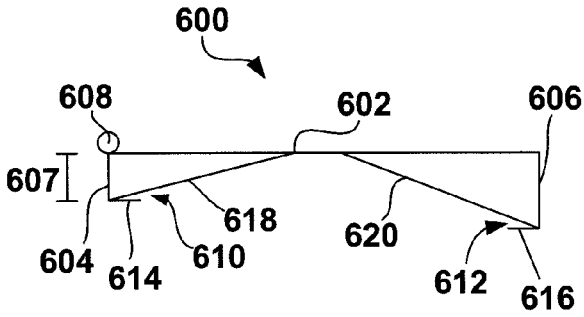
FIGS. 6-7 show top plan views of exemplary display framing systems for clockwise and counter-clockwise opening doors, respectively.
Figure 7:
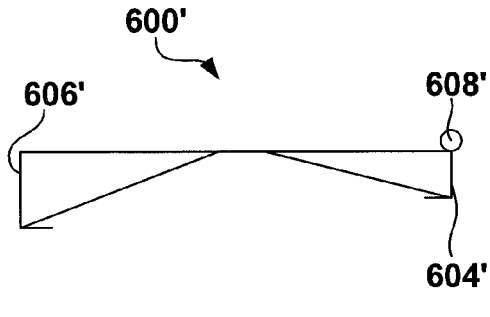

FIGS. 6-7 show top plan views of display framing systems for clockwise and counter-clockwise opening doors, respectively. Referring first to FIG. 6, a back surface 602 is perpendicular to two edges 604, 606 of framing system 600. The outside edge 604 located nearest a hinge 608 has a depth 607 of about 2" while the inside edge 606 has a depth 609 of about 3". Channels 610, 612 are formed between portions of the front surface 614, 616 and longitudinal reflector panels 618, 620 to hold a sign (not shown) in place. A sign may be inserted or removed from channels 610, 612 by slightly bending the sign to secure, or free, at least one edge thereof. Alternatively, a top edge or one or both of side edges 604, 606 of display framing system 600, may open to allow insertion of a sign into framing system 600. In one embodiment, it may be desirable to have the edge(s) lock after the sign has been inserted to prevent theft.

Figure 8:
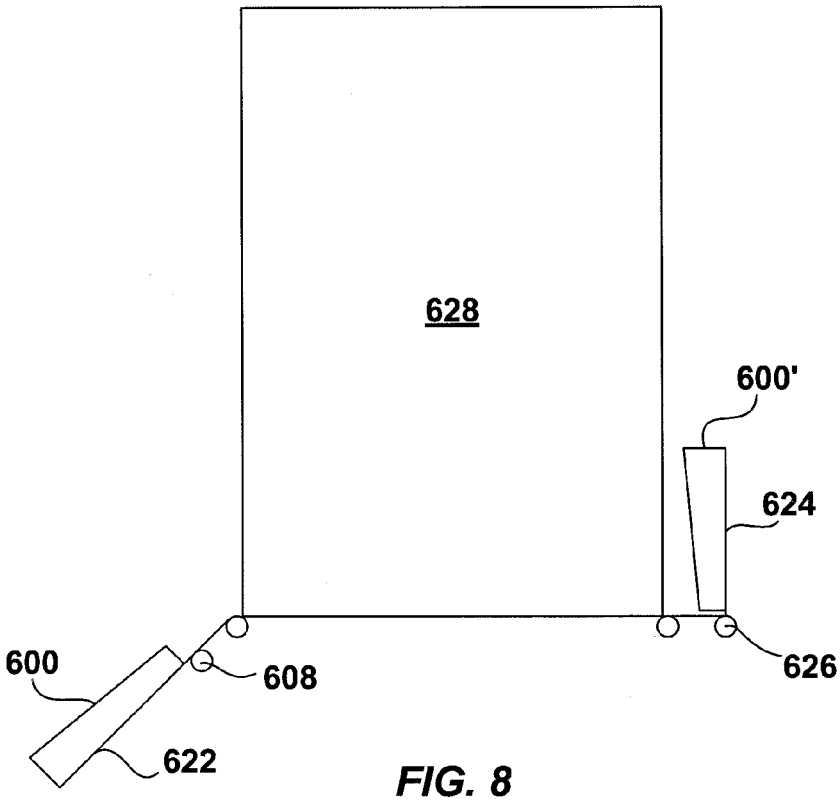
FIG. 8 shows a top plan view of partially and fully opened doors mounted with display framing systems.

FIG. 7 shows an embodiment of a display framing system 600' suitable for a counter-clockwise opening door. The inside edge 606' has a depth of about 3", while the outside edge 604' has a depth of about 2". The canted nature of the framing system allows for opening of vehicle doors without interference from or damage to the framing system or the vehicle. See FIG. 8. Partially and fully opened doors 622, 624 mounted with framing systems 600,600' are, for example, attached with hinges 608, 626 to semi-trailer 628. In one embodiment, the corner formed by outside edge 606 and front surface 616 (FIG. 6) may be coated with a protective, cushioning material, such as rubber, to prevent damage to framing system 600 and semi-trailer 628 when door 622 is opened.

Figure 9:
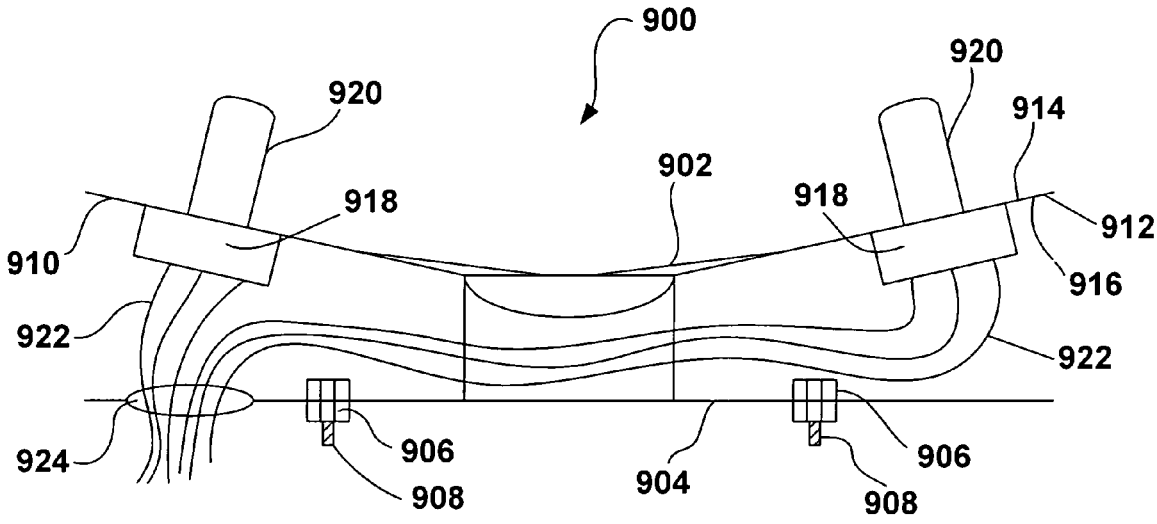
FIG. 9 shows a plan view of an exemplary lighting apparatus for a display framing system according to an embodiment.

FIG. 9 shows a plan view of exemplary lighting apparatus 900 for a display framing system. Lighting apparatus 900 includes a scaffolding 902 with a base plate 904 for mounting to the framing system with nuts 906 and bolts 908 or other means. Scaffolding 902 may also be anchored to the reflector panels using rivets (not shown) to reduce vibrations. The scaffolding 902 further includes extension arms 910, 912 that each have a top surface 914, a bottom surface 916 and a hole (not shown) therethrough. Transformers 918 may be mounted on the bottom surfaces of extension arms 910 and 912 beneath the holes. Light bulbs 920 may be inserted into the transformers 918 through the holes so that the light bulbs 920 are disposed above the top surface 914. Wires 922 from the transformers 918 may exit the framing system through a rubber grommet 924. Power for the lighting apparatus may be supplied by an independent battery or by connection to the vehicle power system, as discussed above.

Figure 10:
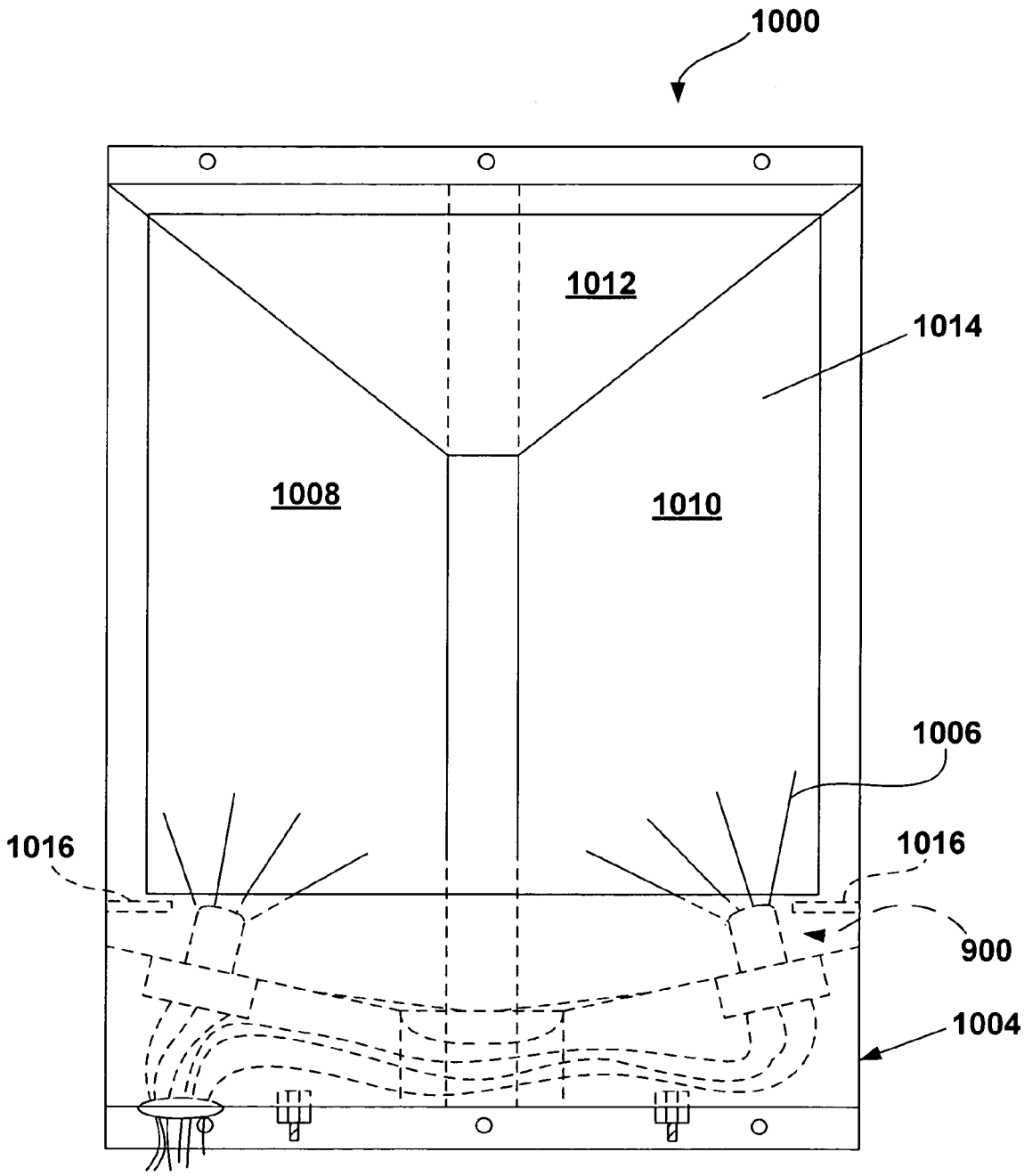
FIG. 10 shows one display framing system according to FIG. 5 and incorporating a lighting apparatus according to FIG. 9.

FIG. 10 shows one display framing system 1000 incorporating lighting apparatus 900 according to FIG. 9. Lighting apparatus 900 is disposed in a bottom 1004 of framing system 1000 with light 1006 from the light bulbs radiated upward. Framing system 1000 may include stoppers 1016 that prevent a sign from resting directly upon lighting system 900. Reflector panels 1008, 1010 and 1012 help to distribute bright and even light through a sign (not shown) inserted in opening 1014.

Figure 11:
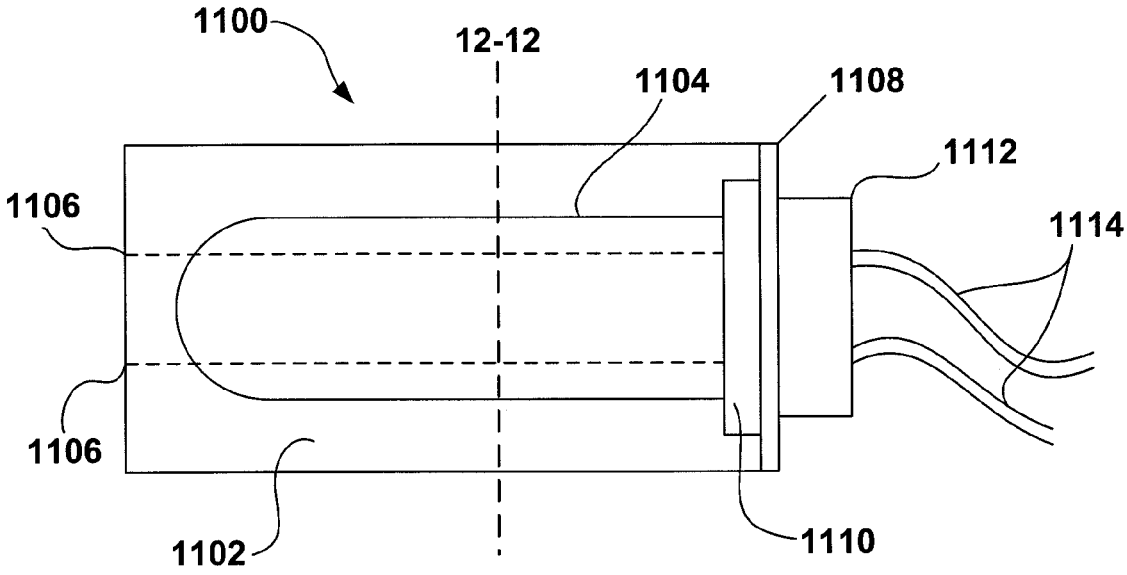
FIG. 11 shows a top plan view of a lighting apparatus for a display framing system according to an embodiment.
Figure 12:
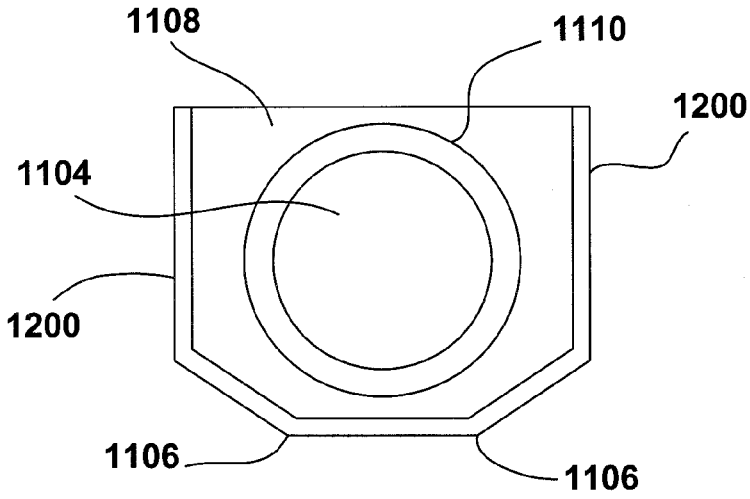
FIG. 12 shows a cross-sectional view of the lighting apparatus of FIG. 11.

FIG. 11 shows a top plan view of another lighting apparatus 1100, which has a reflector cradle 1102 that is sized and shaped to conform to light bulb 1104. A base portion of reflector cradle 1102 is bent at positions 1106 to effectively surround light bulb 1104 when combined with rear wall 1108 and side walls 1200, which are visible in the cross-sectional view taken along plane 12-12, FIG. 12. Light bulb 1104 has a base 1110 that attaches to transformer 1112 through rear wall 1108. Wires 1114 supply power from a battery or vehicle power system to light bulb 1104.

Figure 13:
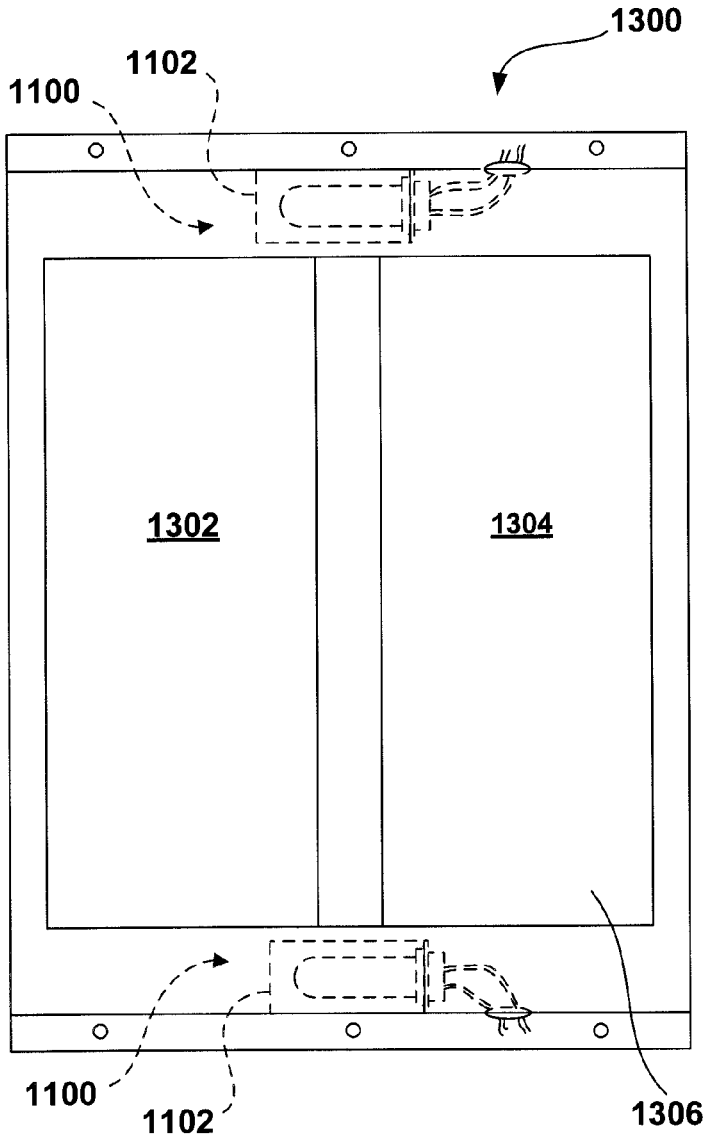
FIG. 13 shows a front plan view of a display framing system incorporating a lighting apparatus according to FIGS. 11 and 12.
Figure 14:
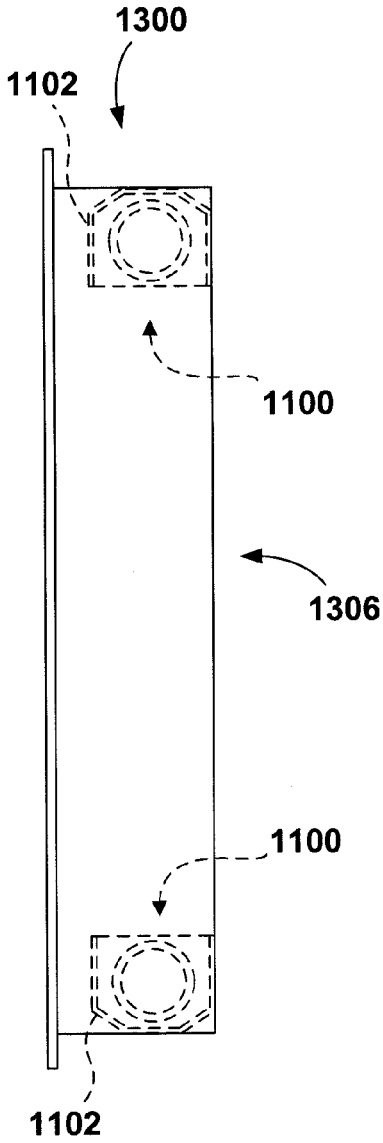
FIG. 14 shows a side plan view of the display framing system of FIG. 13.

FIG. 13 shows a front plan view of a display framing system 1300 incorporating lighting apparatus 1100. Framing system 1300 includes reflector panels 1302, 1304 as well as lighting apparatus 1100 that contain reflector cradles 1102. FIG. 14 is a side plan view of display framing system 1300, where it can be observed that reflector cradles 1102 direct light toward opening 1306.

Additional embodiments of the lighting apparatus are contemplated; for example, the lighting apparatus may incorporate one or a plurality of light bulbs or LEDs, wired in series or parallel, emitting various wavelengths of radiation at constant, pulsed or sequential intervals. The plurality of light bulbs or LEDs may be positioned around the periphery of opening 1014, 1306, for example. In one embodiment, a two-dimensional light emitting device may be disposed on one or more reflector panels or back surface 418 to provide backlighting for signs inserted into opening 1014, 1306. A suitable two-dimensional light emitting device is manufactured by CeeLite™ of Lansdale, Pa.

Each display framing system may include a single lighting apparatus, or more than one lighting apparatus where the multiple apparatus are either of the same type or different types in relation to one another. Additionally, the lighting apparatus may be turned on/off using manual switches, timing devices or light sensing devices that are known in the art.

A sign suitable for use with a display framing system may be made of a plastic polymer, such as Plexiglas® or Lexan®, or materials that are semi-flexible, resistant to shock, vibration and impact and at least partially transparent to light.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. A display framing system comprising:

a door coupled with a vehicle through a hinge, the vehicle comprising a tractor trailer;

four edges disposed on the periphery of and substantially perpendicular to a back surface mounted to the door, the four edges including an outside edge disposed adjacent to the hinge, and an inside edge disposed across the back surface from the outside edge, wherein a depth of the outside edge with respect to the back surface is sufficiently less than a depth of the inside edge with respect to the back surface such that the door may open fully without interference from the framing system; and a front surface disposed planar to the back surface, the front surface forming an opening for insertion of a sign.

2. The display framing system of claim 1, at least one portion of the front surface of sufficient depth to enclose a lighting apparatus.

3. The display framing system of claim 2, further comprising lighting apparatus disposed between the back and front surfaces.

4. The display framing system of claim 3, wherein the lighting apparatus comprises a reflector cradle.

5. The display framing system of claim 3, further comprising a reflector panel disposed between the back and front surfaces, the reflector panel angled toward a center of the framing system such that light from the lighting apparatus reflects, from the reflector panel, through the opening.

6. The display framing system of claim 5, wherein the reflector panel is curved.

7. The display framing system of claim 1, wherein the depth of the outside edge is about 2 inches and the depth of the inside edge is about 3 inches.

8. The display framing system of claim 1, the framing system fabricated of white powdercoated aluminum.

9. The display framing system of claim 1, further comprising the sign, wherein the sign is fabricated from a plastic polymer.

10. The display framing system of claim 1, the four edges consisting of the outside edge, the inside edge, an upper edge and a lower edge, each of the upper edge and the lower edge meeting both the outside edge and the inside edge such that the four edges form a frame about the back surface and the front surface.

11. A method of displaying a sign, the method comprising:

mounting a framing system to a door of a vehicle, the vehicle comprising a tractor trailer, the framing system having four edges disposed on the periphery of and substantially perpendicular to a back surface, the four edges including an outside edge that is disposed adjacent to a hinge that couples the door with the vehicle, and an inside edge opposite the outside edge, wherein a depth of the outside edge is sufficiently less than a depth of the inside edge such that the door may open fully without interference from the framing system, and a front surface disposed planar to the back surface, the front surface forming an opening for insertion of the sign; and inserting the sign into the opening of the front surface.

12. The method of claim 11, further comprising the step of providing lighting apparatus disposed between the back and front surfaces of the framing system.

13. The method of claim 12, further comprising the step of providing at least one reflector panel disposed between the back and front surfaces, the reflector panel angled toward a center of the framing system such that light from the lighting apparatus reflects through the opening.

14. The method of claim 11, the back surface of the framing system and the door being substantially planar, the step of mounting comprising mounting the back surface substantially flush with the door.

* * * * *